US005263696A

United States Patent [19]

Frye

[11] Patent Number: 5,263,696

[45] Date of Patent: Nov. 23, 1993

[54] MATERIAL CLAMPING DEVICE WITH RACK AND PINION DRIVEN ENDLESS BELT

[75] Inventor: Ricky J. Frye, Miamisburg, Ohio

[73] Assignee: MIM Industries, Inc., Miamisburg, Ohio

[21] Appl. No.: 906,736

[22] Filed: Jun. 29, 1992

Related U.S. Application Data

[62] Division of Ser. No. 579,438, Sep. 7, 1990, Pat. No. 5,145,158.

[51] Int. Cl.[5] ..... B42C 1/00; B25B 1/06

[52] U.S. Cl. ..... 270/045; 269/227

[58] Field of Search ..... 270/32, 37, 45, 51, 270/53; 112/2, 113, 121.15, 147, 114; 474/160, 162, 163, 165; 269/227, 239

[56] References Cited

U.S. PATENT DOCUMENTS 3,790,154 2/1974 Gerber et al. ..... 83/451 X 4,505,467 3/1985 Brocklehurst ..... 270/53

4,720,090 1/1988 Ganno et al. ..... 270/45

*Primary Examiner*—Edward K. Look

*Assistant Examiner*—John Ryznic

*Attorney, Agent, or Firm*—Joseph G. Nauman

[57] ABSTRACT

The invention provides a method and apparatus for folding lengthwise and clamping a flexible binding, while leaving the edges of the clamped binding free to be separated such that the edge of a length of extensible netting may be inserted between the free edges. A progressive linear clamp is provided for progressively clamping the combined netting and binding material as the netting is inserted to thereby permit an operator to obtain a substantially uniform stretch of the edge of the netting material, and to apportion the netting evenly along the binding. With the netting material thus inserted and clamped between the edges of the binding, a feed mechanism is positioned to engage the combined binding and netting and feed it to a sewing machine to permanently secure the materials together.

9 Claims, 9 Drawing Sheets

MATERIAL CLAMPING DEVICE WITH RACK AND PINION DRIVEN ENDLESS BELT

RELATED APPLICATION

This application is a division of application Ser. No. 07/579,438, filed Sep. 7, 1990, now U.S. Pat. No. 5,145,158.

BACKGROUND OF THE INVENTION

This application relates to the attachment of a binding to extensible material, and specifically to a method and apparatus which assists an operator of a fastening machine, such as a sewing machine, in preparing the materials for joining, and which conserves operator time and allows concentration of operator attention on the task of properly fitting an edge of the extensible material into the binding, after which the two are clamped and then secured.

Although it will be apparent that the invention is applicable to many different forms of material, and that some features of the invention are per se novel, the specific application for which the invention was made concerns the securing of an edge of a piece of flexible netting, made of extensible cord, to a woven webbing which serves as the binding. There is a demand for such bounded flexible netting, at present, for a variety of uses, one of which is as a hold down device in automobiles and trucks. The webbing is somewhat stiff, usually in the order of two to three inches in width, and of any desired length. The netting is available in a variety of widths, and due to the nature of the open netting and extensibility (stretch) of the cord from which the netting is constructed, it is considerably adjustable in width before securing to the webbing.

At present, to perform this task, an operator must fold the webbing along its length, roughly in half, insert an edge of the netting into the fold and proportion the netting along the binding webbing, hold all of this together, and feed the assembled parts through a sewing machine or the like to secure the netting into the webbing. Obviously, the longer the parts to be joined, the more difficult is this task, and the more likely that there will be lack of uniformity in successively made joined parts. The same difficulties could result, for example, in attempting to join a more stable piece of cloth to a quite flexible and extensible binding. In any event, there is a need to stabilize the parts, allow the operator to fit them together, adjust the relative positions of the parts as needed, clamp them in the final position, and then sew or otherwise secure the parts together. This need applies to a variety of situations in joining such pieces, and to parts of varying length, but the need is more severe as the parts are longer.

SUMMARY OF THE INVENTION

The invention provides methods and apparatus for folding lengthwise and clamping a flexible binding, while leaving the edges of the clamped binding free to be separated. With the binding so folded and immobilized, the operator can fit the edge of a length of extensible netting between the fold of the binding and bring into play a progressive clamp which firmly holds the joined portions of the netting and binding as the operator proceeds. This allows the operator to concentrate on obtaining a substantially uniform stretch of the ed.ge of the netting material, and to apportion such edge evenly along the binding. The clamped parts, once fully fitted together, are then fed through a sewing machine or the like to secure them together.

More particularly, an apparatus is provided in which a length of webbing (serving as the binding) is supported with one of its longitudinal edges fitted along a channel in a supporting table, and the opposite edge of the webbing fitted against a lip on a fold plate which is hinged to the table along, and parallel to, the channel. The plate can be pivoted over the channel, to fold the length of webbing roughly in half (or to some other proportion). Spaced along the plate, near its hinge axis, are a plurality of slots which allow access for clamp fingers which can reach through the slots and pinch the folded edge of the webbing, allowing the fold plate to be opened. At this point, the webbing is secured in folded position, and the free edges of the webbing can be separated to access the space within the fold.

The operator then can begin to insert the edge of the netting piece into the fold of the webbing, working from one end thereof, and apportioning the netting to place it evenly along the webbing, whereby there will be approximately even tension in the netting part of the joined pieces. As this task proceeds, a progressive clamping device is brought into play, most conveniently under operator control through a foot pedal. This clamping device has a pair of spaced apart wheels or pulleys, aligned to move along the channel, with an endless belt reeved around them. The wheels and belt are mounted on a carrier which is supported to be reversibly driven along the channel, under operator control. As the netting is placed into the folded and clamped webbing, the operator can advance the progressive clamping device while proceeding ahead of it to continue to fit the netting edge into the folded webbing. The clamping device holds the interfitted netting into the webbing, by pressing down on the assembled segments, and will continue to do so throughout the length of the webbing piece. Preferably, the belt is a toothed belt, with the teeth arrayed outward to contact the folded over side of the webbing, and as the progressive clamp moves along, there is no relative motion between the belt and the webbing surface, thus the progressive clamping device does not tend to displace or disarray the parts which the operator has placed together, but instead stabilizes these parts and allows the operator to proceed without concern for displacement of the netting edge just fitted into the clamped, folded webbing.

Once the operator has finished the fitting task, the progressive clamping device has control over the full length of the interfitted netting and binding/webbing. At this juncture, a separate feeding head comes into play and is caused to move parallel to the channel (and the progressive clamping device) into alignment with the interfitted parts. An elongated feeding clamp, on the movable feeding head, engages the full length of the interfitted parts, the progressive clamp is released, and the feeding head caries the interfitted parts away, sliding them along the channel and into and through a sewing machine head where the parts are stitched together, or otherwise joined. Once this feeding head clears the area of motion of the progressive clamping device, it can be located in its home position and the operator can enter another piece of webbing between the fold plate lip and channel, cause it to be folded and clamped, and begin fitting the next piece of netting.

The principal object of the invention is to provide a novel method and apparatus for joining a folded binding to an edge of a piece of material, particularly where one or both of the material and binding are flexible and extensible and must be properly apportioned along the length of their joint; to provide such a method and apparatus wherein the binding is folded lengthwise and immobilized with its edges free for receiving the edge of the material to be edge bound; to provide a novel progressive clamping device; to provide such a clamping device which will progressively engage and hold parts to be joined, as by sewing, without relative movement between the contact of the clamping device and the interfitted materials; to provide such a progressive clamping device in an apparatus which assists an operator in the process of placing an edge of material into a folded over binding, to provide a feeding head which will accept transfer of the interfitted pieces from the progressive clamping device at the end of its operation, and move the parts into a sewing head or other appropriate apparatus for permanently securing the pieces together.

Other objects and advantages of the invention will be apparent from the following description, the accompanying drawings and the appended claims.

DETAILED DESCRIPTION OF THE PREFERRED EMBODIMENT

Figure 1:
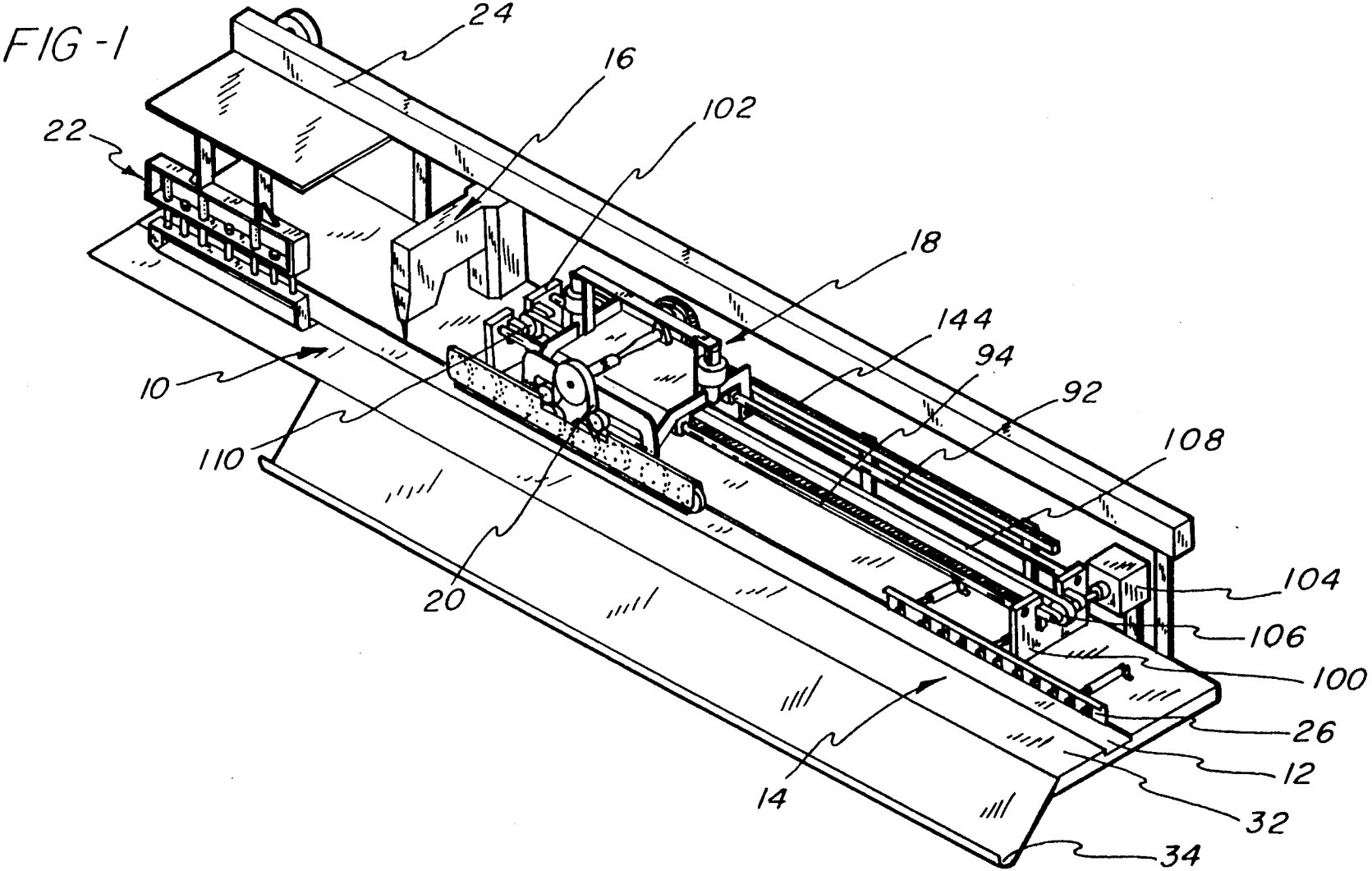
FIG. 1 is a perspective view of the apparatus of the present invention.

FIG. 1 generally shows the apparatus for folding and clamping a pliable binding web 11 to a pliable netting material 13 and for sewing t,he, completed structure. The apparatus includes a work table 10 having an elongated channel 12 formed therein and extending from a folding and clamping station 14 to a sewing station 16.

A progressive linear clamp 18 is mounted for movement parallel to the channel 12 and includes an endless belt 20 forming a clamping surface for progressively clamping material within the channel 12. The belt 20 is preferably a toothed belt having outwardly extending teeth for positively pressing the material in clamping engagement with the channel 12. The progressive linear clamp 18 is movable into and out of the folding and clamping station 14 for purposes to be described further below.

A feed mechanism 22 is supported from an elevated drive rail structure 24. The feed mechanism 22 is movable in a path parallel to the channel 12 along substantially the entire length of the table 10 and includes means for gripping material within the channel 12 and sliding it from the folding and clamping station 14 to the sewing station 16.

In operation of the apparatus, an elongated strip of webbing or binding material 11 is placed in the folding and clamping station such that half of the width of the material 11 extends across the width of the channel 12, and the remaining half of the material 11 extends across a folding plate 26 mounted for pivotal movement adjacent to a longitudinal edge of the channel 12. The plate 26 is then pivoted forwardly to fold the material 11 in half.

Subsequently, a set of clamping fingers 28 is actuated to clamp the folded material 1l along the fold line such that the folding plate 26 may be pivoted upwardly away from the material 11 and the material will be maintained in its folded position within the channel 12.

With the webbing material 11 clamped in place, an operator may then place the edge of a netting material 13 between the free lips of the webbing material 1l extending forwardly of the clamp fingers 28. As material 13 is placed between the lips of the webbing material, the progressive linear clamp 18 is caused to move forward incrementally such that the belt 20 engages and presses together the lip portions of the webbing material 11 to thereby hold the webbing 11 and netting 13 together as a combined structure. The design of the progressive linear clamp 18 is such that the belt is caused to advance into contact with the webbing material at the same lineal rate as the clamp 18 is advanced whereby relative movement between the webbing and the portion of the belt 20 in contact with the webbing is avoided.

With the progressive linear clamp 18 positioned over the entire length of the combined webbing and netting structure, the feed mechanism 22 is brought into position over the combined structure at the longitudinal edge opposite from the clamp fingers 28. With the feed mechanism 22 in position over the combined web and netting structure, the means for gripping the material is actuated to engage and press the combined st:.ucture against the channel 12, and the progressive linear clamp 18 and clamping fingers 28 are moved out of clamping engagement with the combined structure. Thereafter, the feed mechanism 22 slides the combined web and netting structure longitudinally along the channel 12 to the sewing station where the webbing 11 and netting 13 are sewn together adjacent to the outer longitudinal edge of the lips of the webbing material 11.

Figure 2:
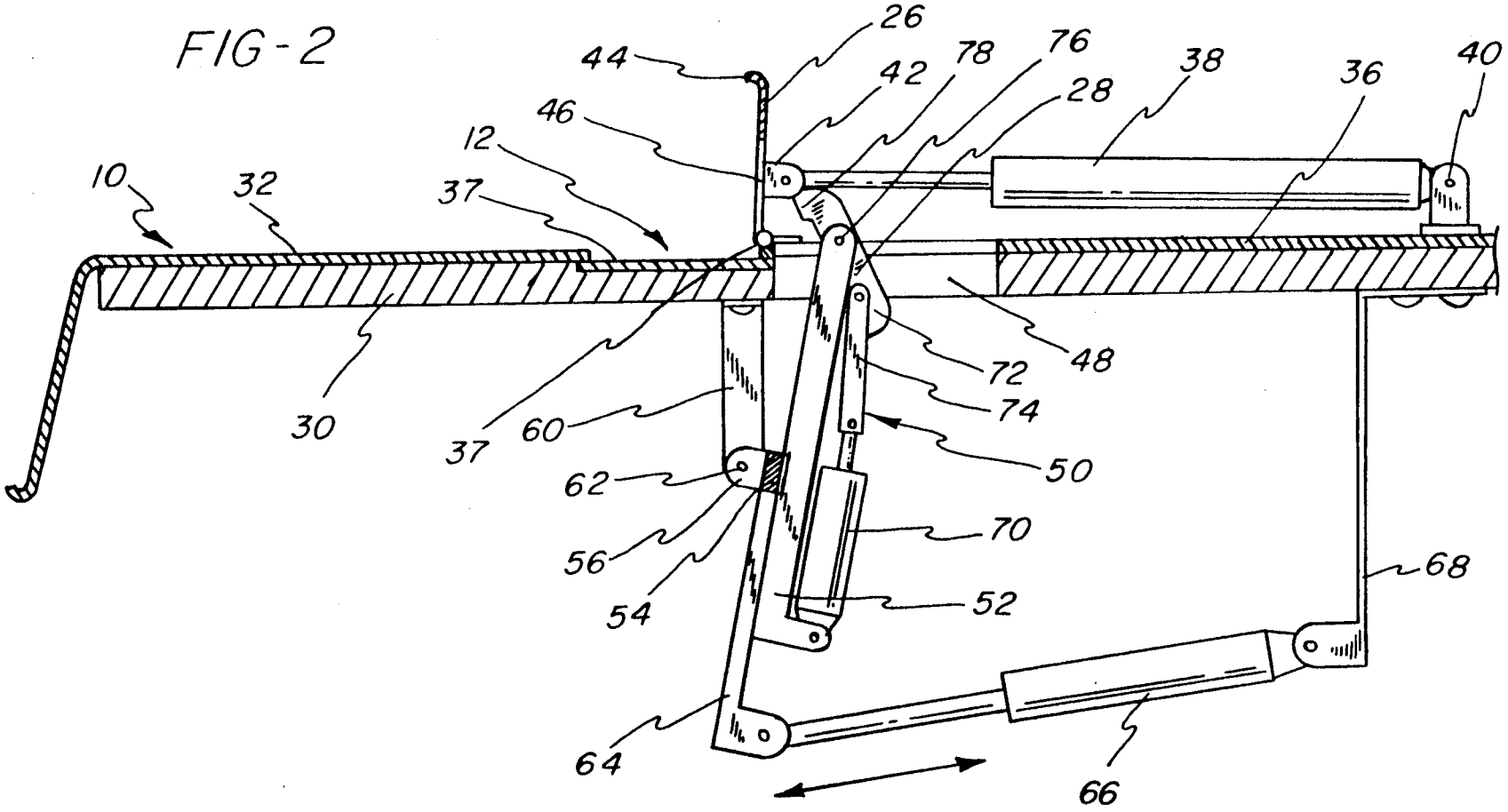
FIG. 2 is an elevational view of the folding and clamping station with the folding plate and clamping fingers in a retracted position.

Referring now to FIG. 2, the particular structure of the folding and clamping station 14 will be described in further detail. Initially, it should be noted that the table 10 includes a primary support structure 30 for supporting a plurality of plates forming the work surface. A front plate 32 is supported by the support structure 30 forwardly of the channel 12 and both the front plate 32 and channel 12 are preferably formed of stainless steel. The front plate 32 includes a material trough 34 at a forward edge thereof for catching any material which may slip off the horizontal portion of the plate 32.

A rear plate 36 is supported by the primary support 30 rearwardly of the channel 12 and forms the support surface for the folding plate 26, the linear progressive clamp 18 and the actuating mechanisms for these devices.

The folding plate 26 is mounted to the rear plate 36 by means of hinges 37 and is preferably formed having a length of approximately 2 ft. The folding plate 26 is actuated for pivotal movenent by means of three equally spaced air cylinders 38. The air cylinders 38 are mounted to the rear plate 36 by pivot means 40 at one end, and at the other end are each attached to a pivot bracket 42 extending from the back side of the folding plate 26.

Figure 3:
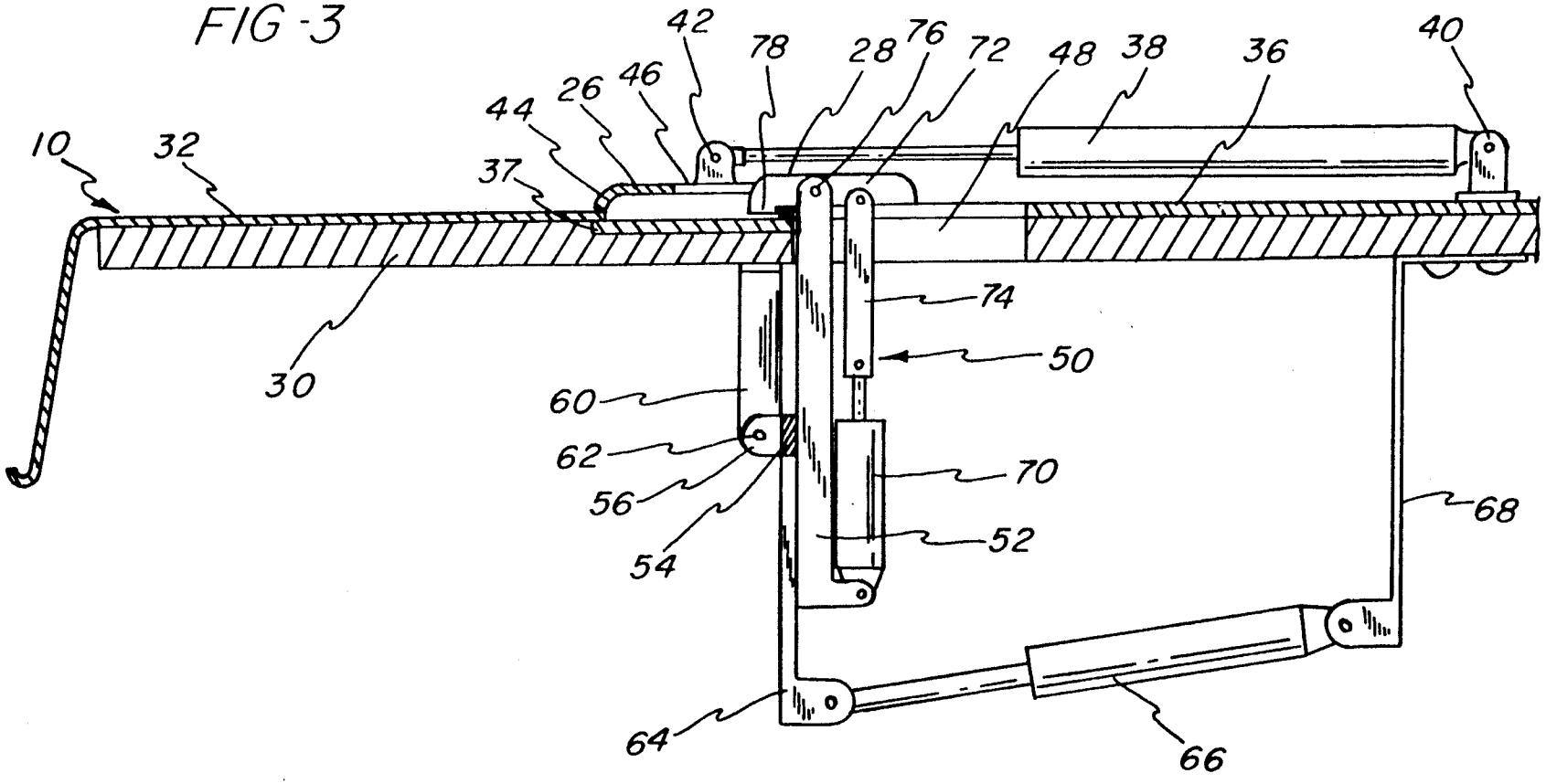
FIG. 3 is an elevational view of the folding and clamping station with the folding plate and clamping fingers in an extended position.

The air cylinders 38 are double acting cylinders and may be actuated to extend the folding plate 26 to a horizontal position overl),ing the entire width of the channel 12, as seen in FIG. 3, and may be actuated in the opposite direction to position the folding plate 26 at a substantially vertical position adapted to permit webbing material to be inserted along the channel 12 and the folding plate 26.

It should be noted that the folding plate 26 includes a lip 44 located along the longitudinal edge of the plate 26 distal from the hinge 37. The lip 44 acts to retain the webbing material 11 in contact with the plate 26 as the plate 26 is pivoted forwardly over the channel 12. In addition, the rearward edge of the front plate 32 defining the forward longitudinal edge of the channel 12 acts to retain the opposing longitudinal edge of the webbing 1l during the folding operation.

Thus, the folding plate 26 and channel 12 are configured such that the webbing material 11 will be held against movement during the folding operation whereby the webbing ii will be folded in half and positioned entirely within the width of the channel 12.

The folding plate 26 is formed with slotted portions 46 extending fron the hinged edge toward the lip edge 44. The slots 46 have a width which is slightly larger than the width of the clamp fingers 28 and each of the slots 46 is aligned with one of the clamp fingers 28.

The clamp fingers 28 are preferably uniformly spaced along the length of the folding plate 26 and, in the preferred embodiment, twelve fingers are provided with each finger spaced approximately 2 inches apart from adjacent fingers.

Each clamp finger 28 is supported for movement toward and away from the channel 12 by an actuation and support structure 50 which extends through a slot 48 formed in the primary support 30 and rear plate 36. In addition, the actuation and support structure 50 includes means for actuating the clamp fingers 28 for pivotal movement down into contact with material in the channel 12.

Referring to FIGS. 2 and 3, the actuation and support structure 50 incl::des a support bar 52 extending substantially vertically &.hrough the slot 48. The support bars 52 for each of the s&ructures 50 are preferably supported by a common longitudinal beam 54, and the beam 54 includes forwardly extending tabs 56 at either end for engaging a support bracket 60 at a pivotal mounting point 62. Thus, the actuation and support structures 50 are mounted for pivotal movement about an axis located below the table 10 and are joined together such that all of the structures 50 will move simultaneously forwardly or rearwardly through their respective slots 48.

A pivot bar 64 extends downwardly from the longitudinal beam 54 and is connected to one end of a double-acting cylinder 66. The other end of the cylinder 66 is supported from a bracket 68 attached to the bottom of the table 10. The cylinder 66 acts to effect the pivotal movement of the actuation and support structures 50 about the pivot point 62.

The actuation and support structure 50 is further provided with a double-acting finger actuation cylinder 70 supported by a lower end of the support bar 52 and having an upper piston end connected to a rearward leg 72 of the finger 28 by means of an extension bar 74. The clamp finger 28 is mounted to the support bar 52 at a pivot point 76 such that, upon actuation of the cylinder 70, the forward portion of the clamp finger 28 will be caused to pivot to an upper or lower position.

It should be noted that the front portion of the finger 28 includes a contact tang 78 extending substantially perpendicular to the longitudinal axis of the finger 28 and is adapted to contact the webbing material located within the channel 12.

The length of the slots 46 in the folding plate 26 are such that the clamping fingers 28 may extend through the slots 46 when the pivot point 76 is in its forwardmost position and when the cylinder 70 has been actuated to move the tang 78 downwardly into the channel 12. In addition, the slots 46 also allow the forwardmost edge of the fingers 28 to move through the plate 26 when the plate 26 is in its upwardly pivoted position and the cylinder 70 has positioned the finger 28 such that the tang 78 is in its upper position. Thus, the plate 26 and the fingers 28 are freely movable relative to each other regardless of their respective positions.

It should also be apparent that the arc of travel of the pivot point 76 is large due to the distance between the pivot 62 and the pivot 76 such that the movement of the actuation and support structure 50 adjacent to the finger 28 is substantially linear as it moves to locate the clamp finger 28 at a forward position where the tang 78 may be pivoted essentially downwardly into contact with the webbing material 1I closely adjacent to the fold line of the material.

Figure 4:
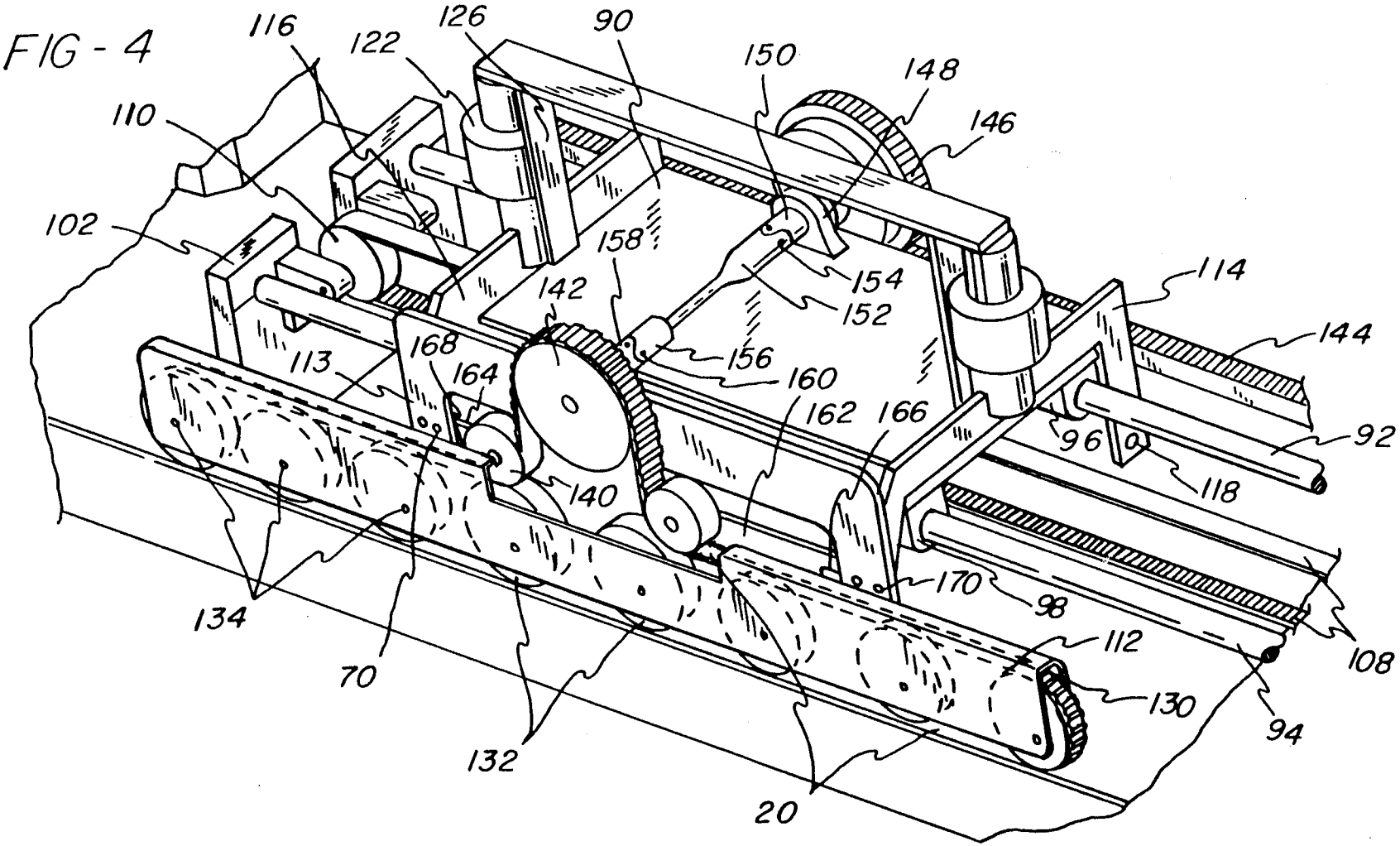
FIG. 4 is a perspective view of the progressive linear clamp.

Referring now to FIG. 4, the particular structure of the progressive linear clamp 18 will be described. The progressive linear clamp includes a clamp base 90 for supporting various components of the clamp 18 and a pair of guide rails 92, 94 are received in bores formed in a pair of bearing blocks 96, 98 attached to the bottom of the clamp base 90. The rails 92, 94 are supported by a pair of rail mountings 100, 102 which position the rails substantially parallel to the channel 12 whereby the clamp 18 may be guided forwardly or rearwardly to and from the folding and clamping station 14.

Further, a motor 104 is located adjacent to one of the rail mountings 100 for driving the clamp 18 in its movement back and forth along the rails 92, 94. A toothed belt 108 having an upper portion thereof attached to the bottom of the clamp base 90, extends around a drive pinion 106 operably connected to the motor 104 to thereby provide the necessary drive connection between the motor 104 and the clamp 18. The rail mounting 102 is provided with an idler roller 110 for supporting the belt 108 at the end opposite from the motor 104. Thus, by causing the motor to rotate in a first direction the clamp 18 is drawn toward the folding and clamping station 14, and by operating the motor 104 in a reverse direction, the clamp 18 is moved away from the folding and clamping station 14.

The progressive linear clamp 18 further includes a tread carrier 1l2 which is carried by a carrier bracket 113 attached to a pair of levers 114, 116. The levers 114, 116 are each attached to the clamp base 90 at pivot points 118 located on a rearward side of the clamp base 90. Thus, the tread carrier 112 is mounted for pivotal movement about the pivot points 118 such that the tread carrier 112 may move toward and away from the table 10 in a substantially vertical plane.

The pivotal movement of the arms 1l4, 116 is controlled by a pair of pancake cylinders 120, 122 which are supported from the clamp base 90 by means of a pair of cylinder brackets 124, 126. The cylinders 120, 122 are of a double acting type such that they may be actuated to either lift the tread carrier 112 or exert a downward pressure to thereby control the amount of pressure applied by the clamp 18 while clamping the web material.

The tread carrier 112 is formed as a clam shell structure of front and rear housing halves 128, 130 which enclose a plurality of pressure roller wheels 132 arranged longitudinally along the interior of the tread carrier 112. The roller wheels 132 are mounted for rotation within the tread carrier 112 by means of axle bolts 134 extending between the front and rear housing halves 128, 130.

The lower edge of the roller wheels 132 extend slightly beyond the lower edge of the front and rear housing halves 128, 130 and the endless belt 20 extends along the lower edge of the roller wheels 132 to thereby define a tread for the progressive linear clamp 18. To this end, the roller wheels 132 are preferably formed with a V-groove and the belt 20 is a V-belt whereby alignment between the rollers 132 and the belt 20 is maintained. In addition, the outer side of the belt 20 may be provided with outwardly extending transverse ribs or teeth 136 for enhancing the contact and preventing relative movement between the belt 20 and the web material ii.

The location of the upper run of the belt 20 is maintained by means of a pair of idler wheels 138, 140 which maintain the belt 20 in contact with the upper portion of the roller wheels 132 as the belt 20 passes to and from the ends of the tread carrier 112. In addition, the belt 20 is guided over a drive wheel 142 positioned between and above the two idler wheels 138, 140.

The drive wheel 142 is driven by means of a rack and pinion assembly located at the rear side of the clamp 18. The rack and pinion assembly includes a rack 144 supported on the rear plate 36 and a pinion gear 146 mounted to the clamp base 90 by means of a bearing assembly I48 such that the pinion gear 146 is continuously held in contact with the rack 144 to thereby rotate a stub shaft 150 as the progressive linear clamp 18 is moved along the bed 10. The stub shaft 150 is connected to a female spline shaft 152 through a universal joint 154. The female spline shaft 152 is in turn connected to a male spline shaft 156 to thereby form a splined slide coupling allowing relative longitudinal movement between the two shafts 152 and 156. Finally, the male spline shaft 156 is connected to a drive shaft 158 through a universal joint 160, and the drive shaft 158 is connected to the drive pulley 142 to thereby drive the belt 20.

Thus, the universal joints 154, 160 and sliding coupling formed by the splined shafts 152, 156 allow the drive shaft 158 to be moved vertically relative to the stub shaft 150 such that, regardless of the particular vertical position of the tread carrier 112, the rack and pinion assembly will continue to drive the belt 20 around the roller wheels 132.

It should be noted that the relative diameters of the pinion gear 146 and drive pulley 142 are selected such that the linear speed of the belt 20 relative to the lower surface of the tread carrier 112 will be equal to the linear speed of the progressive linear clamp 18 relative to the table 10. In this manner, the belt 20 will be driven at a speed such that there will be no relative movement between the table 10 and the portion of the belt 20 passing along the lower side of the roller wheels 132. Thus, as the tread carrier 112 passes over the combined structure of the folded webbing and netting material, the belt 20 will be laid down on the webbing material ii to clamp it in plaoe in such a manner that there will be no relative movement between the belt 20 and the webbing material 1l which would cause the relative position between the netting 13 and the webbing 11 to become distorted.

It should also be noted that the idler rollers 138, 140 are mounted to the carrier bracket 113 by means of adjustable bars 162, 164. Each of the bars 162, 164 is provided with an elongated slot 166, 168 engaged by bolts 170 for holding the bars 162, 164 in place. The slots 166, 168 provide means Whereby the bars 162 164 may be adjusted longitudinally of the tread carrier to thereby vary the tension applied by the idler rollers 138, 140 to the belt 20.

Figure 5:
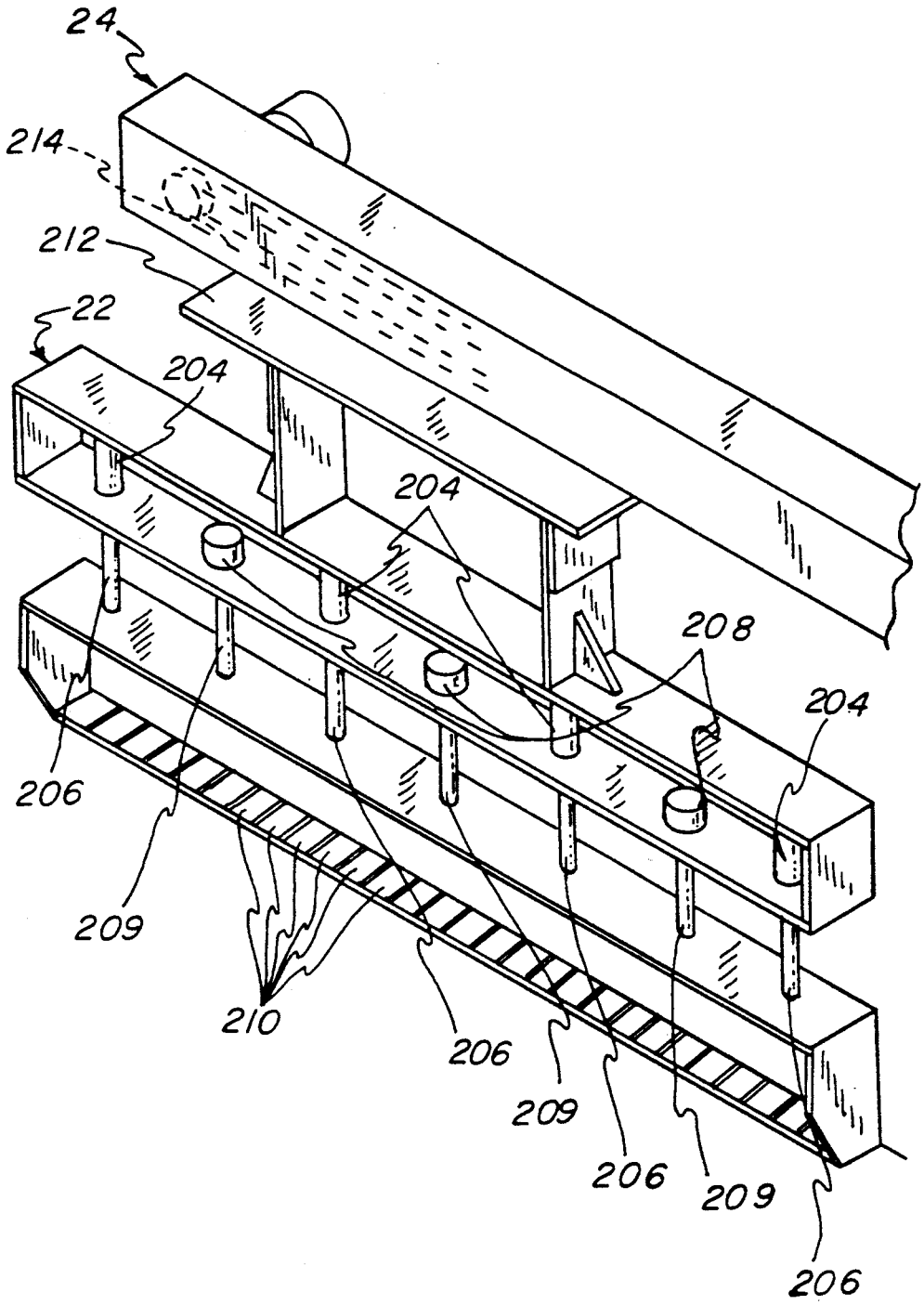
FIG. 5 is a perspective view of the feed mechanism.

Referring to FIG. 5, the feed mechanism 22 is similar to conventional feed mechanisms which are known in the sewing art for conveying material through a sewing machine. The feed mechanism 22 includes an upper carriage 200 and a lower carriage 202 wherein the lower carriage 202 is mounted for vertical movement relative to the upper carriage 200.

The upper carriage 200 includes a plurality of bearings 204 for receiving a plurality of guide rods 206 which are rigidly mounted to the lower carriage 202 whereby the movement of the lower carriage 202 relative to the upper carriage 200 is guided. In addition, the upper carriage 200 is provided with a plurality of double-acting air cylinders 208. The piston portion 209 of each air cylinder 208 is connected to the lower carriage 202 to thereby effect vertical movement of the lower carriage 202 upon actuation of the air cylinders 208.

The lower carriage 202 includes a plurality of spring fingers 210 extending rearwardly from a lower portion thereof. The spring fingers 210 include saw tooth edges which are oriented downwardly for engagement with the webbing material 11 within the channel 12 when the lower carriage 202 is moved to a lowermost position. The spring fingers 210 are formed of a resilient material such that they may accommodate slight variations in vertical height which may occur due to variations in the thickness of the material to be clamped.

The upper carriage 200 is supported from the support rail 24 by means of a suspension bracket 212 which is supported from a lowermost portion of the support rail 24. The support rail 24 is of a conventional design and may include a support track (not shown) and a motor driven belt drive 214 for moving the feed mechanism 22 linearly along the table 10 and into contaot with the material in the folding and clamping station 14.

Figure 6:
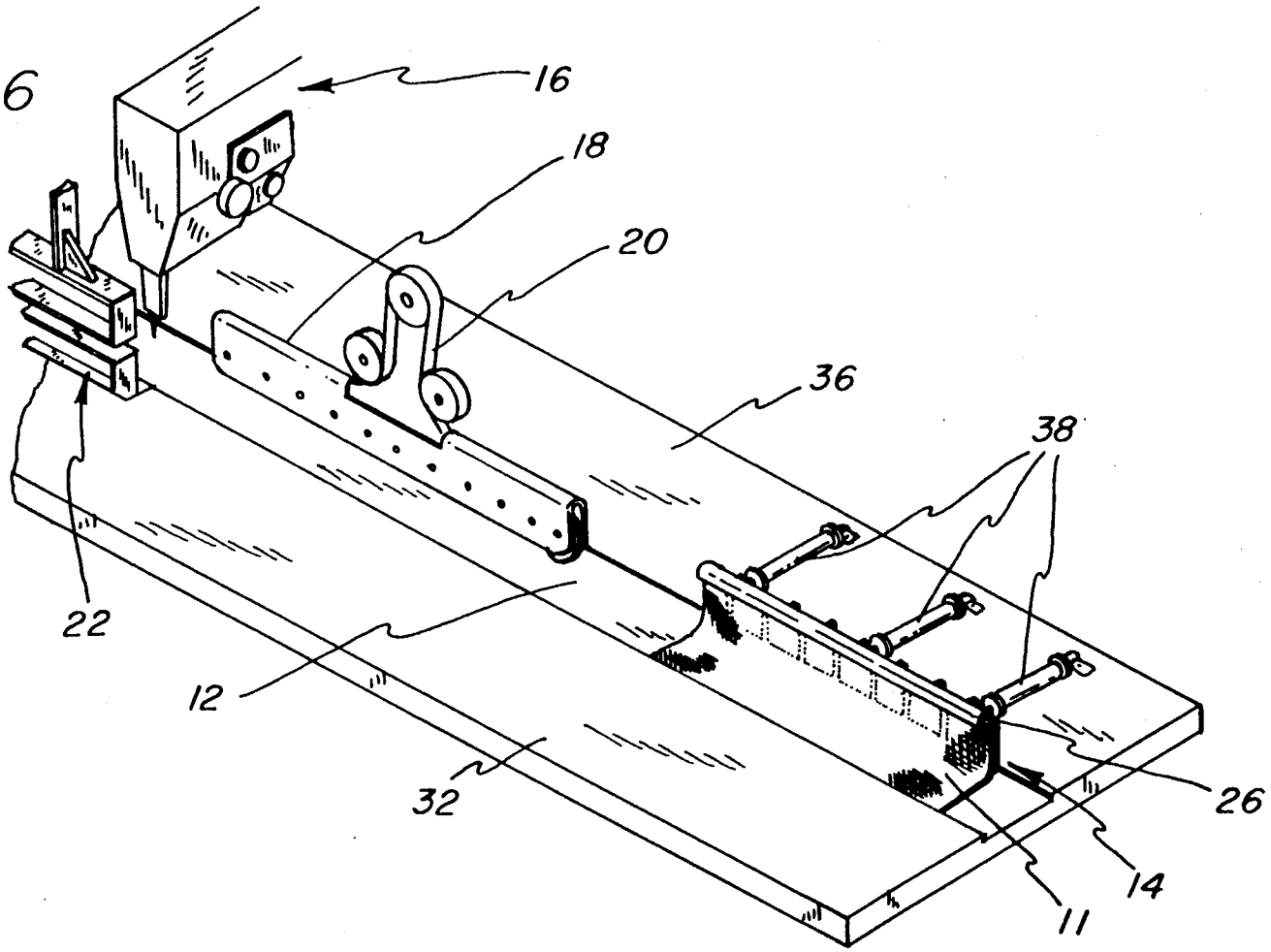
FIGS. 6–9 are diagrammatic views of the steps of the method of attaching binding to an extensible material in accordance with the present invention.

In a typical operation using the above-described device, a strip of webbing material 11 is placed within the channel 12 such that it extends up the folding plate 26 and engages in the lip 44, as depicted in FIG. 6. The air cylinders 38 are then actuated to push the folding plate 26 forward over the channel 12 whereby the web material is positioned folded within the channel 12.

Figure 7:
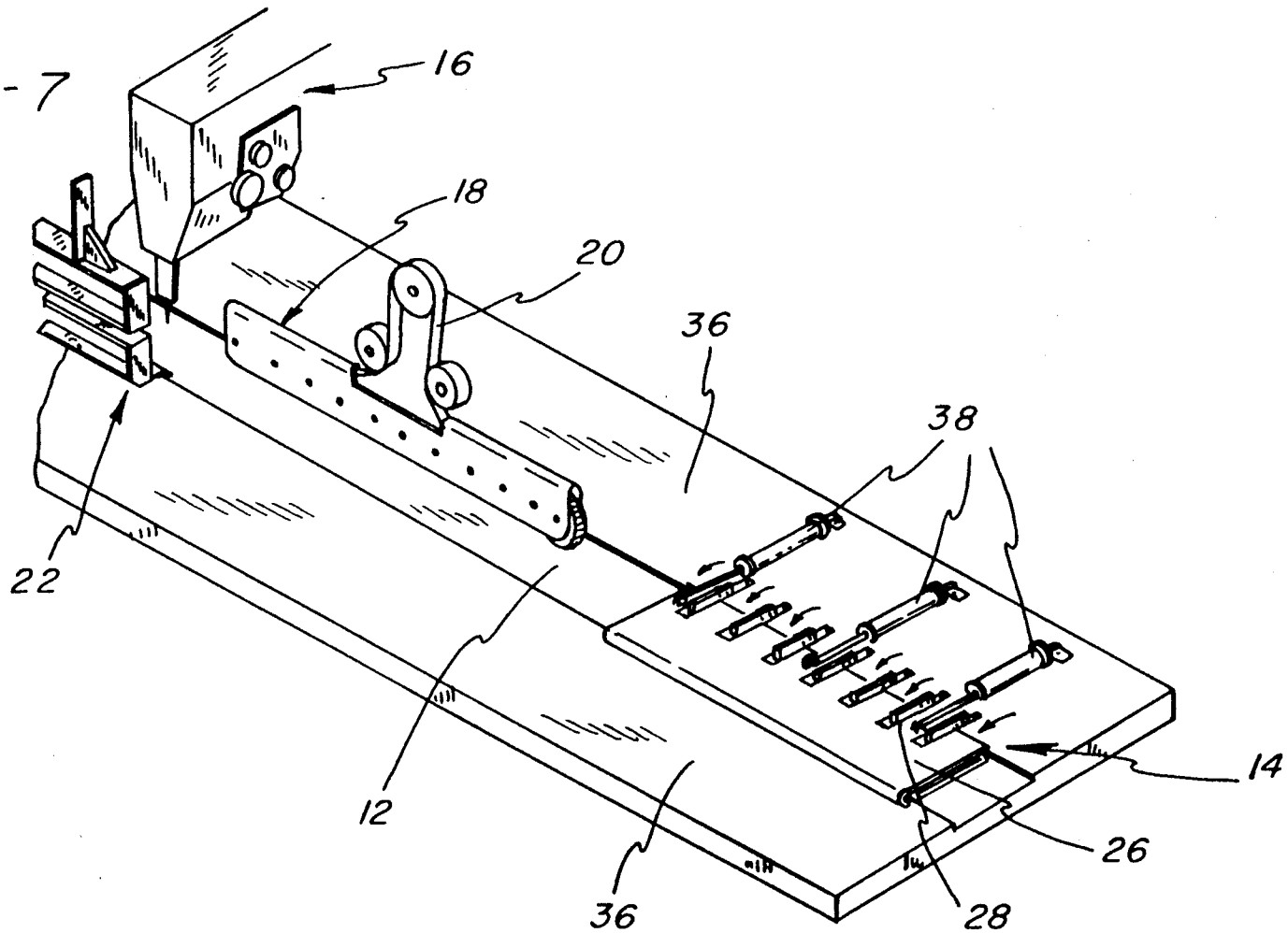

The air cylinder 66 is then actuated to draw the pivot arm 64 rearwardly such that the clamping fingers 28 are simultaneously pivoted or moved forwardly toward the channel 12. Subsequently, the air cylinders 70 are simultaneously actuated to force the tang portion 78 of the clamp fingers 28 downwardly through the slots 46 in the folding plate 26 and into clamping engagement with the webbing material 11 adjacent to the fold line thereof, as depicted in FIG. 7.

With the webbing material 11 thus clamped in place within the channel 12, the air cylinder 38 is actuated to pull the folding plate 26 upwardly out of engagement with the webbing 11 while the clamping fingers 28 remain in position to clamp the folded webbing 11.

The thus folded webbing defines a pair of free lip portions positioned in facing relationship with each other and extending forwardly of the clamping fingers 28. An operator may then manually insert a length of flexible netting 13 between the lip portions starting at the leftmost end of the webbing 11, as seen in FIG. 8.

Figure 8:
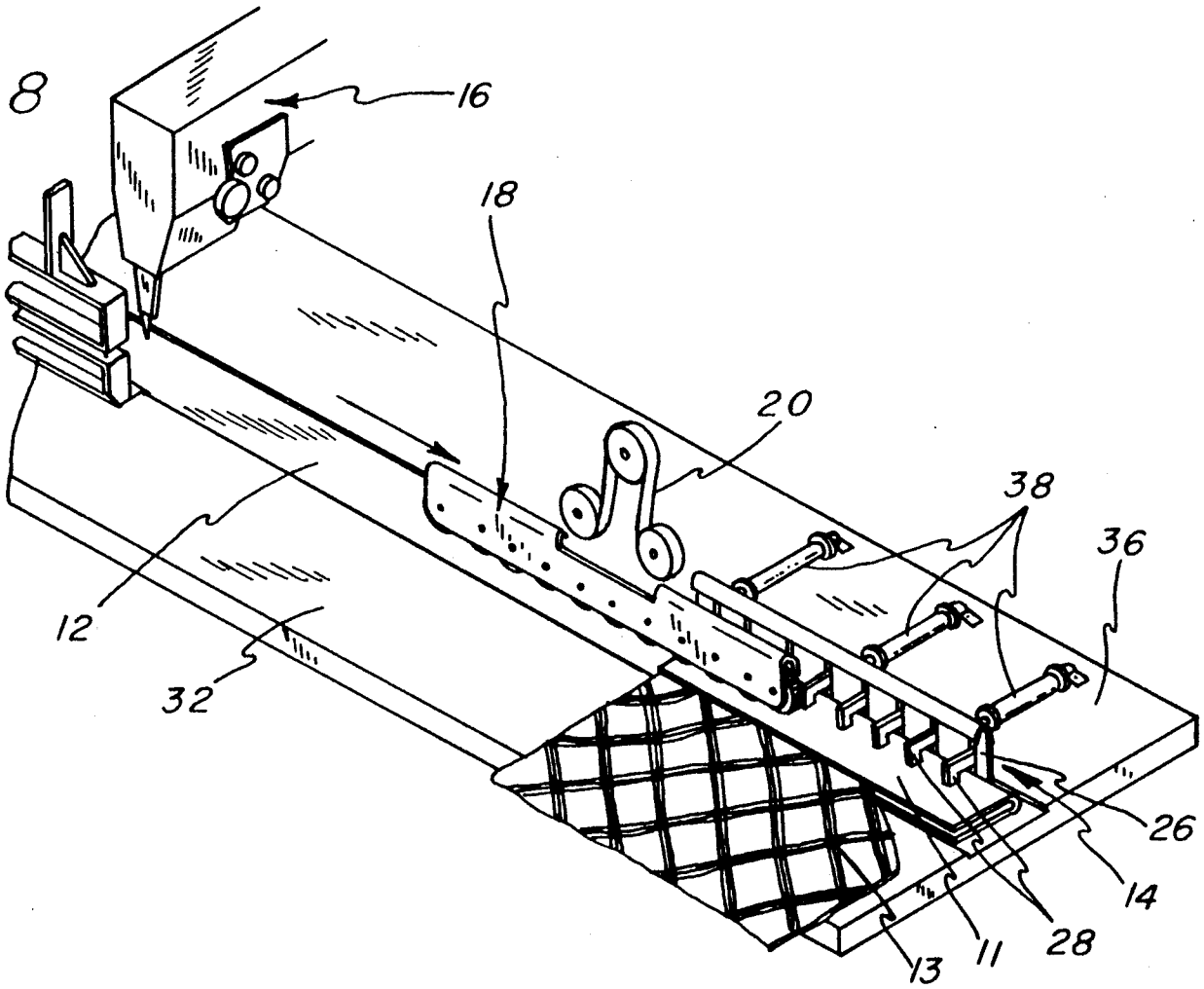

Referring to FIG. 8, as the netting 13 is inserted within the webbing 11, the operator may actuate a foot pedal (not shown) to thereby power the motor 104 to draw the progressive linear clamp 18 toward the folding and clamping station 14. In addition, the cylinders 120, 122 will be actuated to force the tread carrier 112 downwardly with a desired pressure in preparation for engaging the combined web and netting material. The rate at which the clamp 18 is advanced may be adjusted to accommodate the rate at which the particular operator is capable of inserting the netting material 13 between the webbing 11, and in any event the operator controls clamp advancement with the foot pedal.

As noted above, the pinion gear 146 operates in combination with the rack 144 to cause the belt 20 to advance at the same lineal speed as the tread carrier 112 is advanced such that no relative movement occurs between the webbing material 11 and the belt surface in contact with the webbing material 11. Thus, the operator may cause the progressive linear clamp 18 to advance incrementally as additional amounts of netting is inserted between the webbing material 11. Further, if the operator should misestimate the amount of netting material 13 to be inserted into the web 11, the motor 104 may be reversed by the foot actuator to thereby reverse the movement of the clamp 18 and allow a portion of the netting 13 to be removed.

Figure 9:
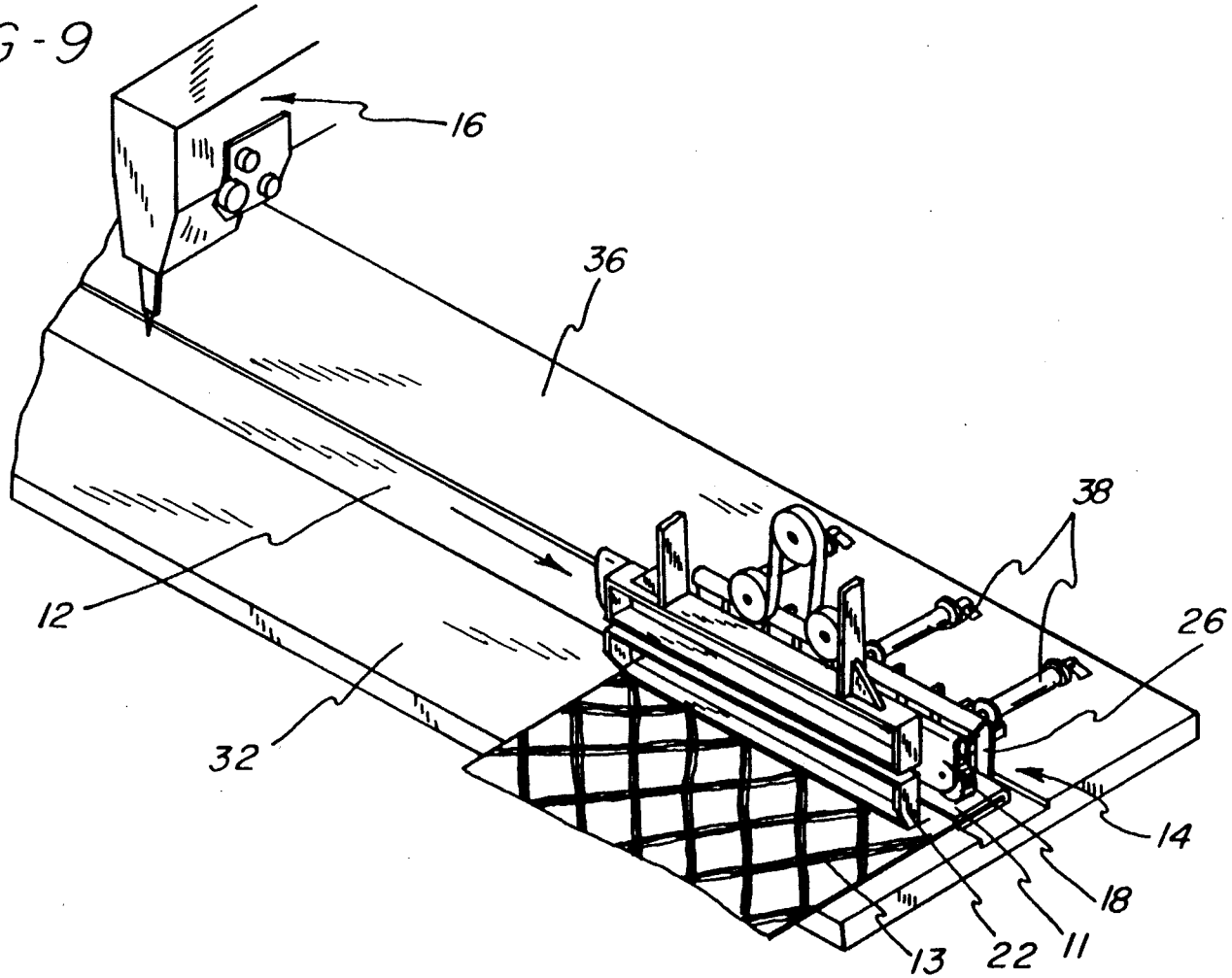

Once the entire length of the netting edge has been inserted between the lips of the webbing and the progressive linear clamp 18 is positioned over the entire length of the combined structure, the feed mechanism 22 is advanced along the support rail 24 to a position adjacent to the progressive linear clamp 18 on the opposite side from the clamp fingers 28. With the feed mechanism 22 thus positioned, the air cylinders 208 may be actuated to force the spring fingers 210 into engagement with the outer longitudinal edge of the lips of the webbing 11. In the preferred embodiment, the serrated teeth of the spring fingers 210 are located approximately ⅛ in. away from the edge of the webbing 11, as depicted in FIG. 9.

With the spring fingers 210 engaged on the webbing 11, the oylinders 66, 70 are actuated to move the clamp fingers 28 back to their retracted position and the cylinders 120, 122 are actuated to move the tread carrier 112 upwardly out of contact with the combined webbing and netting structure. The motor 104 is then activated to move the progressive linear clamp 18 back to its home position to the left of the folding and clamping station 14, as viewed in FIG. 1.

Subsequent to the clamping fingers 28 and progressive linear clamp 18 disengaging from the combined webbing and netting struoture. the feed mechanism 22 is moved along the support rail 24 in the direction of the sewing station 16. As the feed mechanism 22 moves it slides the combined webbing and netting structure longitudinally through the channel 12. A conventional sewing device is provided for sewing the webbing and netting materials together and the belt 214 is preferably actuated to convey the material through the sewing station at a rate which is comparable to the operating rate of the sewing device. After the sewing operation is completed, the combined webbing and netting structure may be conveyed to a conventional material stacking device (not shown).

The operation of the present apparatus may be controlled by means of a conventional microprocessor to automatically feed the completed webbing and netting structure through the sewing station 16 such that, as the feed mechanism 22 is feeding the completed webbing and netting structure through the sewing station 16, the operator may proceed with another operation of folding and clamping a strip of webbing 11 and combining the webbing with a length of netting 13. Thus, the present apparatus provides a combined structure wherein the operator may initiate the formation of an article while the apparatus completes the sewing operation on a preceding article. Consequently, the present apparatus provides an advantage over the prior art methods and apparatus for combining webbing with netting material in that prior art methods require that the webbing and netting be sewn together substantially incrementally as the operator proceeds with the step of inserting the netting into the webbing.

In addition, the present invention provides a convenient means for folding the webbing in half and holding it in such a position to allow an operator to use both hands to insert the netting into the webbing. In particular, the progressive linear clamp provides a convenient temporary means for holding the webbing and netting together until the step of combining the two materials is completed.

It should be noted that the progressive linear clamp may find other applications where a similar need exists for progressively clamping a material and wherein it is necessary to allow an operator to have both hands free to perform other operations than holding the material.

Further, it should be apparent that the present method and apparatus may be performed upon other materials than the webbing and netting disclosed in the present application. However, the present apparatus is particularly suited to performing the above-described operations upon material which is relatively flaccid and difficult to handle.

While the method and apparatus herein described constitutes a preferred embodiment of the invention, it is to be understood that the invention is not limited to this precise method and form of apparatus, and that changes may be made therein without departing from the scope of the invention which is defined in the appended claims.

What is claimed is:

1. A sewing apparatus including a device for progressively clamping material comprising:

a work table having a support surface for supporting material to be clamped, a clamp frame, an endless belt supported by said clamp frame and having a tread portion for engaging and biasing the material towad said support surface, guide means for guiding said clamp frame for movement in a predetermined direction across said support surface, actuating means for driving said clamp frame progressively across said material in said predetermined direction, rollers on said clamp frame contacting said belt and defiing a loop path on said clamp frame for said belt, and drive means operated by and synchronized with siad actuating means for positively driving said belt arond its loop path on said clamp frame such that the linear rate of movement of said belt relative to said clamp frame at points of contact between said belt and the material is equal to the rate of movement of siad clamp frame relative to said support surface.

2. THe device of claim 1 wherein an elongated continuous contact patch is defined by contact between the tread portion of said endless belt and the material on said support surface.

3. The device of claim 1, further including a stationary rack supported along and parallel to the path of movement of said clamp frame, a pinion gear rotatably supported on said clamp frame and in engagement with said rack, said pinion gear being operably connected to said endless belt whereby movement of said pinion gear along said rack results in corresponding movement of said endless belt.

4. The device of cliam 1, further including a plurality of rollers mounted in said clamp frame and together defining the path of the tread portion of said endless belt.

5. A sewing apparatus including a device for progressively clamping material comprising:

a clamp frame, a support surface for supporting material to be clamped, an endless surface supported by said clamp frame for engaging and biasing said material toward said support surface, guide means or guiding said frame for movement in a predeterined direction, actuating means or causing said frame to move progressively across said material in said predetermined direction, and said endless surface being movable relative to said frame such that the linear rate of movement of said endless surface relative tos aid frame at points of contact between said endless surface and said material is substantially equal to the rate of movement of siad frame relative to said support surface, drive means for driving said endless surface including a stationary rack fixed to said support surface parallel to said guide means and a pinion gear in engagement with asid rack, said pinion gear being operable conected to said endless surface such that movement of siad pinion gear along asid rack results in movement of said endless surface coresonding to movement of said clamp frame.

6. THe device of claim 5 wherein an elonated continuous conact patch is defined by contact between said endless surface and the material, and sid patch moves along the material during movement of said clamp frame over said support surface.

7. The device of claim 6 wherein said endless surface is formed by an endless belt.

8. The device of claim 7, further including a drive pulley supported on said frame and connected to said pinion gear, a pluraltiy of roller wheels supported in spaced apart relation for free rotation on said frame and defiing the lenth of the contact patch, idler wheels supported on said frame adjacent said drive pulley and guiding said belt arond said roller wheels such taht said movement of said pinion ear results in rotation of said drive pulley and movement of said belt with respect to said roller wheels.

9. The device of claim 5 wherein said frame is mounted for substantially vertical movement whereby siad endless surface may be lifted outof engagement with adn biased into engagement wih asid material.

* * * * *